US011495871B2

(12) United States Patent
Vosoogh et al.

(10) Patent No.: US 11,495,871 B2
(45) Date of Patent: Nov. 8, 2022

(54) WAVEGUIDE DEVICE HAVING MULTIPLE LAYERS, WHERE THROUGH GOING EMPTY HOLES ARE IN EACH LAYER AND ARE OFFSET IN ADJOINING LAYERS FOR LEAKAGE SUPPRESSION

(71) Applicant: METASUM AB, Gothenburg (SE)

(72) Inventors: Abbas Vosoogh, Gothenburg (SE); Zhongxia Simon He, Särö (SE)

(73) Assignee: METASUM AB, Gothenburg (SE)

( * ) Notice: Subject to any disclaimer, the term of this patent is extended or adjusted under 35 U.S.C. 154(b) by 38 days.

(21) Appl. No.: 16/758,454

(22) PCT Filed: Oct. 26, 2018

(86) PCT No.: PCT/SE2018/051099
§ 371 (c)(1),
(2) Date: Apr. 23, 2020

(87) PCT Pub. No.: WO2019/083439
PCT Pub. Date: May 2, 2019

(65) Prior Publication Data

US 2020/0251799 A1 Aug. 6, 2020

(30) Foreign Application Priority Data

Oct. 27, 2017 (SE) ..... 1751333-4

(51) Int. Cl.
*H01P 3/12* (2006.01)
*H01P 11/00* (2006.01)

(52) U.S. Cl.
CPC ..... *H01P 3/121* (2013.01); *H01P 3/12* (2013.01); *H01P 11/002* (2013.01)

(58) Field of Classification Search
CPC ..... H01P 3/121; H01P 1/2005; H01P 1/2002; H01P 1/2088
(Continued)

(56) References Cited

U.S. PATENT DOCUMENTS 3,292,115 A * 12/1966 La ..... H01P 3/122 333/208
5,382,931 A 1/1995 Piloto
(Continued)

FOREIGN PATENT DOCUMENTS

CN 105958167 A 9/2016
CN 106941203 A 7/2017
(Continued)

OTHER PUBLICATIONS

Ebrahimpouri, M. et al. "Design Guidelines for Gap Waveguide Technology Based on Glide-Symmetric Holey Structure" IEEE Microwave and Wireless Components Letters, vol. 27, No. 6, Jun. 2017.

(Continued)

*Primary Examiner* — Benny T Lee
(74) *Attorney, Agent, or Firm* — Duane Morris LLP; Gregory M. Lefkowitz; Randall C. Pyles

(57) ABSTRACT

A multi-layer waveguide device, a multi-layer waveguide arrangement, and a method for production thereof, wherein the multi-layer waveguide comprises at least three horizontally divided layers assembled into a multi-layer waveguide. The layers are at least a top layer, an intermediate layer, and a bottom layer, wherein each layer has through going holes extending through the entire layer. The holes are arranged with an offset to adjacent holes of adjoining layers creating a leak suppressing structure.

16 Claims, 8 Drawing Sheets

(58) Field of Classification Search
USPC ..... 333/239
See application file for complete search history.

(56) References Cited

U.S. PATENT DOCUMENTS

| | | | | |
|---|---|---|---|---|
| 5,982,256 | A | 11/1999 | Uchimura | |
| 6,154,106 | A | 11/2000 | De Lillo | |
| 6,523,248 | B1 | 2/2003 | Snygg | |
| 6,774,748 | B1 | 8/2004 | Ito | |
| 2010/0182105 | A1 | 7/2010 | Hein | |
| 2012/0013499 | A1* | 1/2012 | Hayata | H01P 5/107 342/112 |
| 2016/0285165 | A1 | 9/2016 | Legay | |
| 2018/0026324 | A1 | 1/2018 | Miller | |
| 2018/0248245 | A1 | 8/2018 | Okada | |
| 2018/0375185 | A1 | 12/2018 | Kirino | |
| 2020/0185802 | A1 | 6/2020 | Mlenskiy | |
| 2020/0220245 | A1 | 7/2020 | Algaba | |
| 2020/0251799 | A1 | 8/2020 | Vosoogh | |

FOREIGN PATENT DOCUMENTS

| | | |
|---|---|---|
| CN | 110646868 | 1/2020 |
| EP | 1376746 | 1/2004 |
| JP | 2012209655 | 10/2012 |

OTHER PUBLICATIONS

Dawn, D., et al., "A Novel Electromagnetic Bandgap Metal Plate for Parallel Plate Mode Suppression in Shielded Structures" IEEE Microwave and Wireless Components Letters, vol. 12, No. 5, May 2002.

Hessel, A., et al. "Propagation in Periodically Loaded Waveguides with Higher Symmetries," Proceedings of the IEEE, vol. 61, No. 2, Feb. 1973.

Ebrahimpouri, M. et al. "Design of Microwave Components in Groove Gap Waveguide Technology Implemented by Holey EBG," 2017 11th European Conference on Antennas and Propagation (EUCAP).

Bastioli, S., et al., "TM Dual-Mode Pseudoelliptic Filters using Nonresonating Modes," 2010 IEEE MTT-S International Microwave Symposium, Anaheim, CA, 2010, pp. 880-883, doi: 10.1109/MWSYM.2010.5518108.

Chen, X.P., et al., "Substrate Integrated Waveguide Filter With Improved Stopband Performance for Satellite Ground Terminal," IEEE Transactions on Microwave Theory and Techniques, vol. 57, No. 3, Mar. 2009.

Bastoli, S., "Nonresonating Mode Waveguide Filters," IEEE Microwave Magazine, vol. 12, No. 6, pp. 77-86, Oct. 2011, doi: 10.1109/MMM.2011.942009.

Bastoli, S., et al., "New Class of Waveguide Dual-Mode Filters Using TM and Nonresonating Modes," IEEE Transactions on Microwave Theory and Techniques, vol. 58, No. 12, Dec. 2010.

Gatti, F., et al., "A Novel Substrate Integrated Coaxial Line (SICL) for Wide-Band Applications," 2006 European Microwave Conference, Manchester, 2006, pp. 1614-1617, doi: 10.1109/EUMC.2006.281409.

Wong, S.W., et al., "U-Shape Slots Structure on Substrate Integrated Waveguide for 40-GHz Bandpass Filter Using LTCC Technology," IEEE Transactions on Components, Packaging and Manufacturing Technology, vol. 5, No. 1, pp. 128-134, Jan. 2015, doi: 10.1109/TCPMT.2014.2367516.

Jung, D.Y., "High-Q Circular LTCC Resonator Using Zigzagged via Posts and a Short Stub for Millimeter-Wave System-on-Package Applications," Advanced Packaging, IEEE Transactions on. 32. 216-222. 10.1109/TADVP.2008.2007237.

El-Akhdar, A.M., et al., "A Study of Double via Row Configuration for SIW Based Structures," 2016 28th International Conference on Microelectronics (ICM), Giza, 2016, pp. 77-80, doi: 10.1109/ICM.2016.7847912.

El-Akhdar Abdelrahman M et al, "A study on double via row configuration for SiW based structures", 2016 28th International Conference on Microelectronics (ICM), IEEE, (Dec. 17, 2016).

Dong Yun Jung et al, "High-Q Circular LTCC Resonator Using Zigzagged via Posts and a $\ambda/4$ Short Stub for Millimeter-Wave System-on-Package Applications", IEEE Transactions on Advanced Packaging., Piscataway, NJ, USA, (Jan. 9, 2009), vol. 32, No. 1, doi:10.1109/TADVP.2008.2007237, ISSN 1521-3323, pp. 216-222, XP055542570.

Wong Sai-Wai et al, "U-Shape Slots Structure on Substrate Integrated Waveguide for 40-GHz Bandpass Filter Using LTCC Technology", IEEE Transactions on Components, Packaging and Manufacturing Technology, IEEE, USA, vol. 5, No. 1, doi: 10.1109/TCPMT.2014.2367516, ISSN 2156-3950, (Nov. 24, 2014), pp. 128-134, (Jan. 13, 2015), XP011569907.

Fabrizio Gatti et al, "A Novel Substrate Integrated Coaxial Line (SICL) for Wide-Band Applications", Microwave Conference, 2006. 36th European, Pi, (Sep. 10, 2006), doi:10.1109/EUMC.2006.281409, ISBN 978-2-9600551-6-0, pp. 1614-1617, XP055542924.

Ebrahimpouri, M., et al., "Low-cost metasurface using glide symmetry for integrated waveguides," 2016 10th European Conference on Antennas and Propagation (EuCAP), 2016, pp. 1-2.

Tian, Y., "Fabrication of multilayered SU8 structure for terahertz waveguide with ultralow transmission loss," Journal of Micro/Nanolithography, MEMS, and MOEMS 13(1), 013002 (Jan. 6, 2014).

Nocella, V., et al., "Dual-band filters based on TM dual-mode cavities", In: "2014 44th European Microwave Conference, European Microwave Association", Oct. 6, 2014, pp. 179-182.

Quevedo-Teruel, O., et al., 'Ultrawideband Metasurface Lenses Based on Off-Shifted Opposite Layers', in: IEEE Antennas and Wireless Propagation Letters, vol. 15, pp. 484-487, 2016.

Tamayo-Dominguez, A., et al., 'Space Reduction Between Parallel Gap Waveguides Using Stacked Glide-Symmetric Metal Sheets', in: 13th European Conference on Antennas and Propagation, pp. 1-5, Mar. 2019.

Kirino, H., et al., A 76 GHz Multi-Layered Phased Array Antenna Using a Non-Metal Contact Metamaterial Waveguide, in: IEEE Transactions on Antennas and Propagation, vol. 60, No. 2, Feb. 2012.

Zaman, A.U., et al., 'Overview of High Frequency Electronics Integration Concepts for Gap waveguide based High Gain Slot Antenna Array', in: IEEE International Conference on Microwaves, Antennas, Communications and Electronic Systems, pp. 1-4, Nov. 2019.

Vosoogh, A., et al., 'Novel Air-Filled Waveguide Transmission Line Based on Multilayer Thin Metal Plates', in: IEEE Transactions on Terahertz Science and Technology, vol. 9, No. 3, pp. 282-290, May 2019.

* cited by examiner

WAVEGUIDE DEVICE HAVING MULTIPLE LAYERS, WHERE THROUGH GOING EMPTY HOLES ARE IN EACH LAYER AND ARE OFFSET IN ADJOINING LAYERS FOR LEAKAGE SUPPRESSION

CROSS-REFERENCE TO RELATED APPLICATIONS

This application is a § 371 national stage entry of International Application No. PCT/SE2018/051099, filed Oct. 26, 2018, which claims priority of Sweden National Application No. 1751333-4, filed Oct. 27, 2017, the entire contents of which are incorporated herein by reference.

TECHNICAL FIELD

The present invention relates generally to a multi-layer waveguide (MLW) that is cost-effective to produce and that is possible to surface mount.

BACKGROUND ART

Waveguides are well known in the art and are common components being used to carry electromagnetic waves from a starting point to an endpoint. For example, a waveguide can be formed as a hollow metal pipe.

For waves propagating in open space, power is lost over distance, thereby reducing both the possible transmission distance and the quality of the waves. A waveguide is a structure adapted to guide waves by restricting the expansion directions of the wave in at least one dimension. The concept is to restrict the wave by forcing the wave to propagate in a specific direction and thereby reducing the losses. In ideal conditions, this concept would result in the wave losing no power at all. However, this is rarely or never the case. In practice, and depending on the waveguide design, there is leakage and the waves couple to edges of the waveguide channels, thereby creating energy losses. The concept of waveguides has been known for a long time and is used for transmitting for example signals, sound, or light.

SUMMARY OF THE INVENTION

Although many different forms of waveguides are known in the art there are drawbacks with the current solutions. It has been realized during the development of the present solution that it, for example, is difficult to produce waveguides that are suitable for application areas requiring surface mounted waveguides.

In general applications for electromagnetic radio waves, rectangular waveguides could be used, that is, waveguides that are essentially a hollow metal structure with a rectangular cross section. Such waveguides can for example be produced by two blocks of metal that are assembled into a waveguide. Such waveguides may have a top and a bottom layer assembled together. Part of these two layers may be cut out, so that when these two layers, when assembled together, form a hollow space as waveguide. The two blocks need to have good connectivity to reduce leakage. However, due to the fact that only small portions of the layers are cut out and larger portions are remain only for mechanical support, the waveguides blocks are in general bulky and heavy in most case and not suitable for surface mounting and/or light weight applications.

Another solution is to use so called "dielectric waveguides". There is a difference between dielectric waveguides and air-filled metal surface waveguides. In metal surface waveguides, the magnetic fields penetrate a short distance into the metal, but the leaks become substantial if there is a gap between two layers, especially if the gap is in the horizontal direction. The reason for this leakage is that the electromagnetic waves are tightly confined and meant to penetrate only a very short distance into the metal. For dielectric waveguides, the characteristic of the problem is different due to, for example, the non-propagating evanescent wave. The different characteristics of the problem is also the reason why metal surface waveguides without features as described in the present disclosure requires a high level of conductivity between layers to reduce leakage.

A further problem in relation to manufacturing of waveguides is that the current level of Computer Numerical Control (CNC) milling and molding often provides bad tolerances in the production method compared to other methods, such as laser cutting or etching. This makes it difficult and/or expensive to produce waveguide structures for surface mounted applications. The problem is more evident for some frequency ranges than for others, for example both CNC-milling and molding are common production methods for waveguides adapted for frequencies below 80 GHz. For waveguides, in the D-band frequency range, that is, 110 GHz to 170 GHz, the CNC-milling and molding becomes very expensive because everything is very small in relation to how the production technology works. It is in some cases therefore not suitable and in some cases not even possible to achieve the desired result.

For frequency ranges that are well above 100 GHz there are manufacturing methods with etching on, for example, a silicon wafer (instead of metal block), that are used to partly solve the production problem. However, due to the properties of a waveguide, these manufacturing methods are not suitable for frequency ranges below 200 GHz. The reason for this lack of suitability is that it is difficult to perform deep etching (for example, more than 300 um) on silicon wafers.

Accordingly, some waveguides are too big to be suitable for silicon chips, but too small for forming molded or CNC-milled versions. Further, leakage and loss of power are common problems for waveguides. The inventor has realized that a waveguide with many layers generally suffers from high levels of leakage, especially if the layers are stacked on top of each other, where the interface between the layers is in a horizontal plane.

There are also other production methods, for example based on using many layers of copper to make waveguides for the frequencies in the D-band frequency range, that is, in the range 110-170 GHz. For these methods, diffusing bounding may be used to enable good conductivity between layers, which reduces the leakage from the waveguide. However, this is both expensive and requires special equipment and is not suitable for mass-production of big waveguide structures. Diffusion bonding, also referred to as diffusion welding, is a solid-state welding technique used in metalworking, capable of joining similar and dissimilar metals. It operates on the principle of solid-state diffusion.

To briefly describe the background situation relating to the solution described herein: There is a gap around the 80-200 GHz frequency range where the CNC-milling tolerance is not enough (and as previously mentioned, CNC-milling is not suitable for mass-production), where a waveguide needs to be larger than what is suitable to produce with silicon etched solutions and where the bonded copper solution is to expensive and difficult to manufacture for high volume products. Further, leakage is in general a problem for all types of layered waveguides. With applications, such as drones, space applications, automotive car radars, airplanes, and similar, weight reduction is a critical factor, as well as compatibility with surface mounting to access high volumes.

Thus, it would be advantageous with a waveguide that can be surface mounted and is compact, light, and that fulfils performance requirements of the market without requiring any difficult production method. It would further be beneficial with a type of waveguide that can be used for at least all the aforementioned frequency ranges without limitations of previous solutions. It shall be noted that the present solution as described herein can be used also for other frequencies ranges than the D-band frequency range, and thereby can replace waveguides produced with any of the other production methods. It should further be noted that the structure of the present solution could be produced with CNC-milling and thereby a single type of waveguide can be used for many different application areas.

An object of the present invention is to provide a waveguide that is easy to produce.

Another object of the present invention is to provide a waveguide that is cost effective to produce.

Another object of the present invention is to provide a waveguide that is suitable for the millimeter wave frequency band (30-300 GHz).

Another object of the present invention is to provide a waveguide solution that could be used for a wide range of frequencies.

Another object of the present invention is to provide a multi-layer waveguide that reduces leakage.

Another object of the present invention is to provide a multi-layer waveguide that don't require galvanic contact between the layers to reduce leakage.

Another object of the present invention is to provide a multi-layer waveguide that does not require connectivity between the layers to reduce leakage.

Another object of the present invention is to provide a waveguide with less weight than prior art solutions.

Another object of the present invention is to provide a waveguide with low form factor.

Yet another object of the present invention is to provide a production method for a multi-layer waveguide according to the aforementioned objects.

Thus, the solution relates to a multi-layer waveguide comprising at least three horizontally divided layers assembled into a multi-layer waveguide. The layers are at least a top layer, an intermediate layer, and a bottom layer. Each layer has through going empty holes extending through the entire layer and the empty holes are arranged with an offset to adjacent empty holes of adjoining layers, thereby creating a leak suppressing structure.

It is one advantage with the present solution that the holes are extending through the entire layer making it easier to produce. The holes of adjoining layers that are arranged with an offset in relation to each other is further advantageous due to that it creates a leak suppressing structure based on EBG, electromagnetic band gap structure.

Electromagnetic band gap (EBG) structure materials or structures creating EBG structures are designed to prevent the propagation of a designated bandwidth of frequencies and is in the present solution used to minimize the leakage in the multi-layer waveguide. This enables that a waveguide with many layers to be used without the drawbacks that such a solution previously had.

It should further be noted that in other solutions, where electrical and galvanic contact is needed between the layers, there are much more leakage in the horizontal plane than in the vertical plane.

According to one embodiment, the holes are not aligned but arranged in an array of unit cell pattern creating an EBG structure.

According to one embodiment, the multi-layer waveguide further comprises a second top layer arranged on top of the top layer and a second bottom layer arranged underneath the bottom layer, wherein the second top and bottom layers comprise holes that extend only partly through the layer.

According to one embodiment, the holes are offset from each other with a higher order symmetry.

According to one embodiment, the holes are arranged with an offset so that each hole overlaps between two and four holes in the adjoining layer.

According to one embodiment, the holes of an intermediate layer are arranged with an offset so that each hole overlaps between two and four holes in the adjoining layer arranged above and the adjoining layer arranged below the intermediate layer.

According to one embodiment, the holes of every second layer align.

According to an embodiment of the multi-layer waveguide, the layers are made from either the same material or different materials. The layers could for example be made from a metallic material, or a non-metallic material, coated with a conductive surface.

According to an embodiment, the multi-layer waveguide is an air-filled rectangular waveguide.

According to an embodiment, the multi-layer waveguide is a metal waveguide.

According to an embodiment, the multi-layer waveguide is a metal surface waveguide.

According to an embodiment, the multi-layer waveguide is a rectangular metallic waveguide.

According to an embodiment of the multi-layer waveguide, the layers of the multi-layer waveguide is held together with any one of a conductive glue, an isolating glue, and two screws.

One advantage with the present solution is that any form of bonding or attachment means can be used to hold the layers together. The reason for this advantage is that no electric conductivity is required between the layers to suppress leakage. However, it shall be noted that conductivity won't affect the performance in a negative way. This is why the multi-layer waveguide according to the solution described herein works well regardless of the conductive properties between the layers.

According to an embodiment, the multi-layer waveguide is held together with less than three attachment means, preferably screws or rivets.

According to an embodiment, there is a gap dividing the layers.

One advantage with the multi-layer waveguide as described herein is that a small gap between the layers won't affect the waveguide properties. This is contrary to most other waveguides, where a gap significantly would increase the leakage.

According to an embodiment, each of the layers has a different pattern of holes and/or elongated aperture.

According to an embodiment of the multi-layer waveguide, the holes are of any suitable shape, preferably circular, triangular, square, pentagonal, rectangular, hexagonal, or any other shape. It is understood that the shape of the holes in the layers won't affect the functionality as long as the EBG property is achieved.

According to an embodiment of the multi-layer waveguide, the holes in the layers are arranged to achieve an electromagnetic band gap structure in the material.

According to an embodiment, the distance between the holes in each layer is smaller than the wavelength that the multi-layer waveguide is designed for.

According to an embodiment, the diameter of the hole is between 0.4*lambda-0.6*lambda and the period of the holes is between 0.8*lambda-1.2*lambda, wherein lambda is the wavelength in free space.

According to an embodiment, the diameter of the hole is approximately 0.4*lambda and the period of the holes is approximately 0.8 lambda, wherein lambda is the wavelength in free space.

According to an embodiment, the diameter of the hole is approximately 0.5*lambda and the period of the holes is approximately 1.2*lambda, wherein lambda is the wavelength in free space.

According to an embodiment, the holes reoccur in a repeating pattern.

According to an embodiment, the multi-layer waveguide comprises a waveguide channel. The waveguide channel is an elongated aperture in at least one intermediate layer.

One advantage is that the waveguide channel of the multi-layer waveguide can be produced as a through going elongated aperture in one or more intermediate layers. From a production perspective, it is much easier to produce an aperture that extends through the entire thickness of a layer than to produce a slot that only extends part of the thickness. By arranging multiple layers, the waveguide channel is created as an enclosed space made of the one or more elongated apertures. In one embodiment, the top and bottom layers are, together with the sides of the elongated apertures, corresponding to enclosing members creating a waveguide channel.

According to an embodiment, the multi-layer waveguide comprises a waveguide channel inlet, aligning with a start of the waveguide channel, and a waveguide channel outlet, aligning with an end of the waveguide channel. The waveguide channel inlet is arranged in the top layer or the waveguide channel inlet is arranged in the bottom layer. For the outlet, the waveguide channel outlet is arranged in the top layer or the waveguide channel outlet is arranged in the bottom layer.

According to an embodiment, the multi-layer waveguide comprises a waveguide channel inlet aligning with a start of the waveguide channel and a waveguide channel outlet aligning with an end of the waveguide channel, wherein the waveguide channel inlet is arranged in any one of:

in the top layer, and in the bottom layer, and the waveguide channel outlet is arranged in any one of:

in the top layer, and in the bottom layer.

According to an embodiment of the multi-layer waveguide, the waveguide comprises a top layer that has a waveguide channel inlet aligning with a start of the waveguide channel in the intermediate layer, and a waveguide channel outlet aligning with the end of the waveguide channel in the intermediate layer.

According to an embodiment of the multi-layer waveguide, the waveguide comprises at least one row of holes arranged around the waveguide channel.

According to an embodiment of the multi-layer waveguide, the waveguide comprises at least two rows of holes are arranged around the waveguide channel.

According to an embodiment of the multi-layer waveguide, the layers of the multi-layer waveguides have the same size.

According to an embodiment, the multi-layer waveguide has at least a first, a second, and a third intermediate layer and each intermediate layer comprises an elongated aperture arranged concentric for each intermediate layer.

According to an embodiment of the multi-layer waveguide, the elongated aperture in the first intermediate layer is longer than the elongated aperture in the second intermediate layer and the elongated aperture in the second intermediate layers is longer than the elongated aperture in the third intermediate layer.

It is one advantage that through changing the length of the elongated apertures in each intermediate layer it is possible to achieve a step structure at each end of the waveguide channel in the assembled multi-layer waveguide. This enables the inlet and outlet to be directed either upwards or downwards enabling surface mounting of the waveguide.

According to an embodiment of the multi-layer waveguide:

the first, second, and third intermediate layers each comprises an elongated aperture, and the second intermediate layer further comprises a central member arranged within the elongated aperture.

It is one advantage with the multi-layer structure of the waveguide, that a coaxial waveguide can be produced in an effective way via arranging a central member in the elongated aperture of an intermediate layer. It is further an advantage with coaxial waveguides that the coaxial waveguides create a compact waveguide structure. The center member in one embodiment on fills part of the width of the elongated aperture in the intermediate layer.

It is yet another advantage that a rectangular coaxial transmission line, such as the coaxial multi-layer waveguide as described herein, creates a waveguide structure with more than one octave bandwidth.

Another advantage is that the coaxial waveguide as described herein is suitable for use as an antenna or a filter.

Yet another advantage with the present solution is that a waveguide transmission line can be used to design and achieve various type waveguide devices, for example slotted array antennas, filters, rectangular waveguides, and coaxial waveguides.

According to an embodiment of the multi-layer waveguide, the waveguide channel comprises multiple side flanges extending in a direction perpendicular to the extension direction of the waveguide channel.

One advantage with the side flanges is that the side flanges reduce leakage through minimizing the waves ability to couple with the edge and forcing the wave to propagate in a specific direction. Waves coupling to the edge of a waveguide loses energy which is at least in part prevented with the flanges as described herein.

According to an aspect, a multi-layer waveguide arrangement comprises a multi-layer waveguide according to embodiments as above and wherein an active component is arranged in the waveguide channel of the multi-layer waveguide.

An advantage is that an integrated circuit, such as a monolithic microwave integrated circuit (MMIC) or any other form of active component, may be arranged within the waveguide channel.

According to an aspect, a layer fora multi-layer waveguide is a layer adapted for a multi-layer waveguide and/or a multi-waveguide arrangement as described above.

According to an aspect for producing a multi-layer waveguide, the production comprises the steps of etching or laser cutting:

a top layer comprising at least one row of through going holes surrounding an elongated area in the center area of the layer, at least one intermediate layer comprising at least one row of through going holes surrounding an elongated area in the center area of the layer and wherein an elongated aperture is etched or laser cut into the elongated area, and a bottom layer comprising at least one row of through going holes surrounding an elongated area in the center area of the layer.

According to one embodiment, the rows of through going holes are arranged with an offset between adjoining layers.

According to an aspect for producing a multi-layer waveguide, the production comprises the steps of etching or laser cutting:

a top layer comprising at least two rows of through going holes surrounding an elongated area in the center area of the layer, at least one intermediate layer comprising at least two rows of through going holes surrounding an elongated area in the center area of the layer and wherein an elongated aperture is etched or laser cut into the elongated area, and a bottom layer comprising at least two rows of through going holes surrounding an elongated area in the center area of the layer.

According to an embodiment, the production further comprises the step of etching or laser cutting:

a waveguide channel inlet and a waveguide channel outlet into the top layer.

According to an embodiment, the production further comprises the step of etching or laser cutting:

a waveguide channel inlet into any one of the top layer or the bottom layer, and a waveguide channel outlet into any one of the top layer or the bottom layer.

According to an embodiment, the layers are held together with any one of a conductive glue, an isolating glue, or screws.

The multi-layer waveguide according to embodiments herein has multiple advantages. It is for example cost efficient to produce, through going holes are easier to produce than slots, leakage is reduced without any expensive bonding process, etc.

BRIEF DESCRIPTION OF THE DRAWINGS

The invention is described, by way of example, with reference to the accompanying drawings, in which.

DETAIL DESCRIPTION OF THE EMBODIMENTS

In the following, a detailed description of different embodiments of the invention are disclosed with reference to the accompanying drawings. Individual features of the various embodiments and aspects may be combined or exchanged unless such combination or exchange is clearly contradictory to the overall function of the multi-layer waveguide, arrangement, or production method thereof.

Briefly described, the solution relates to a multi-layer waveguide without any requirement for electrical and galvanic contact between the layers. The multi-layer waveguide has a leak suppressing structure for reducing leakage between the layers of said waveguide. The leak suppressing structure comprise multiple holes that are arranged in at least one row surrounding the waveguide channel and the holes are arranged with an offset between the layers thereby creating an EBG-structure (electromagnetic band gap).

Figure 1:
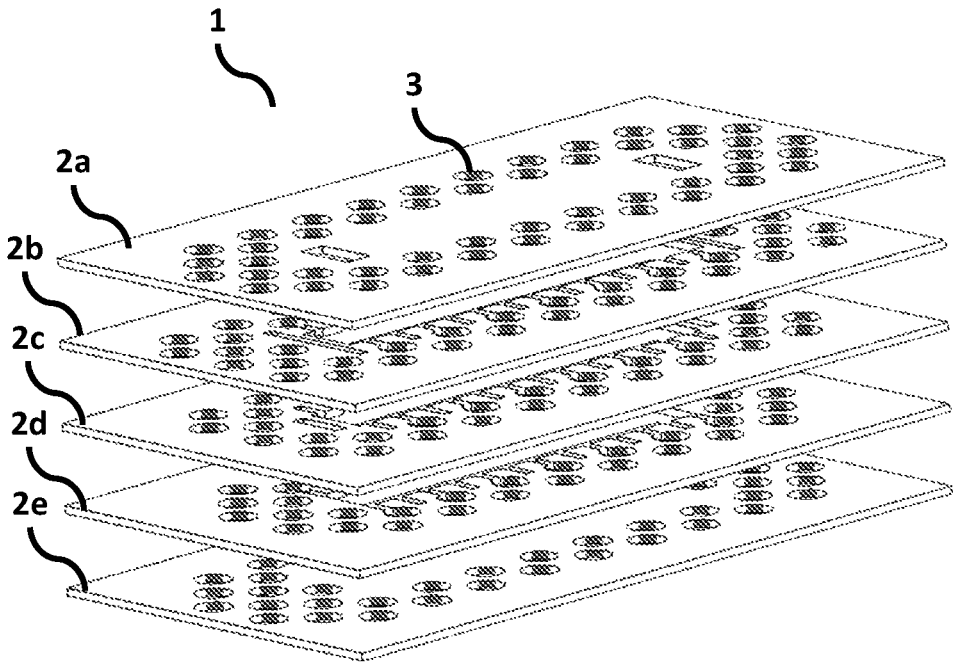
FIG. 1 illustrates one embodiment a multi-layer waveguide.

FIG. 1 illustrates one embodiment of layers 2*a*, 2*b*, 2*c*, 2*d*, 2*e* for a multi-layer waveguide 1. The layers as illustrated in FIG. 1 each comprises holes 3 that are arranged with an offset between the different layers, or at least between adjoining layers. FIG. 1 further illustrates the orientation of said layers, where the top layer 2*a* is above the intermediate layers 2*b*, 2*c*, 2*d* and the intermediate layers 2*b*, 2*c*, 2*d* are above the bottom layer 2*e*. However, it should be noted that any number of layers can be used within the multi-layer waveguide and the multi-layer waveguide can be arranged in any direction during use. The orientation and how that relates to the order of the layers is merely for explanatory reasons. However, in some embodiments the multi-layer waveguide may be arranged as illustrated and described herein.

Figure 2:
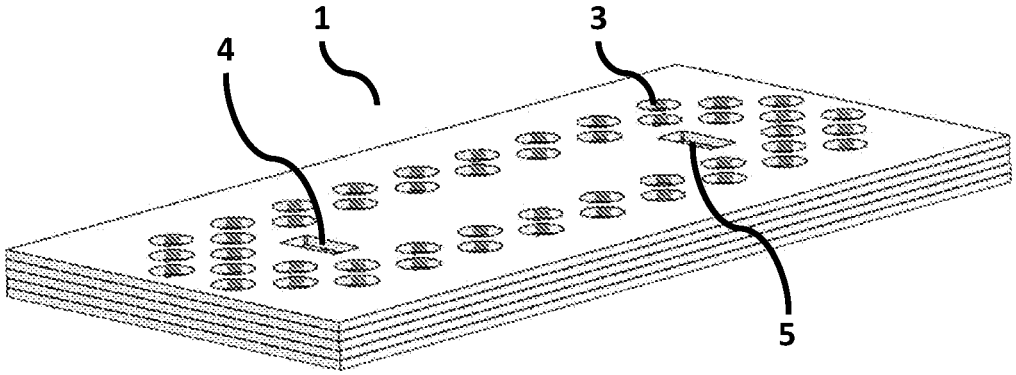
FIG. 2 illustrates one embodiment of an assembled multi-layer waveguide comprising the layers as illustrated in FIG. 1.

FIG. 2 illustrates a multi-layer waveguide 1 comprising the layers of FIG. 1. FIG. 2 further illustrates how the waveguide 1 comprises a waveguide channel inlet 4 and a waveguide channel inlet 5 being apertures, holes 3, or openings in the top layer 2*a*, as shown in FIG. 1, of the multi-layer waveguide 1.

Figure 3:
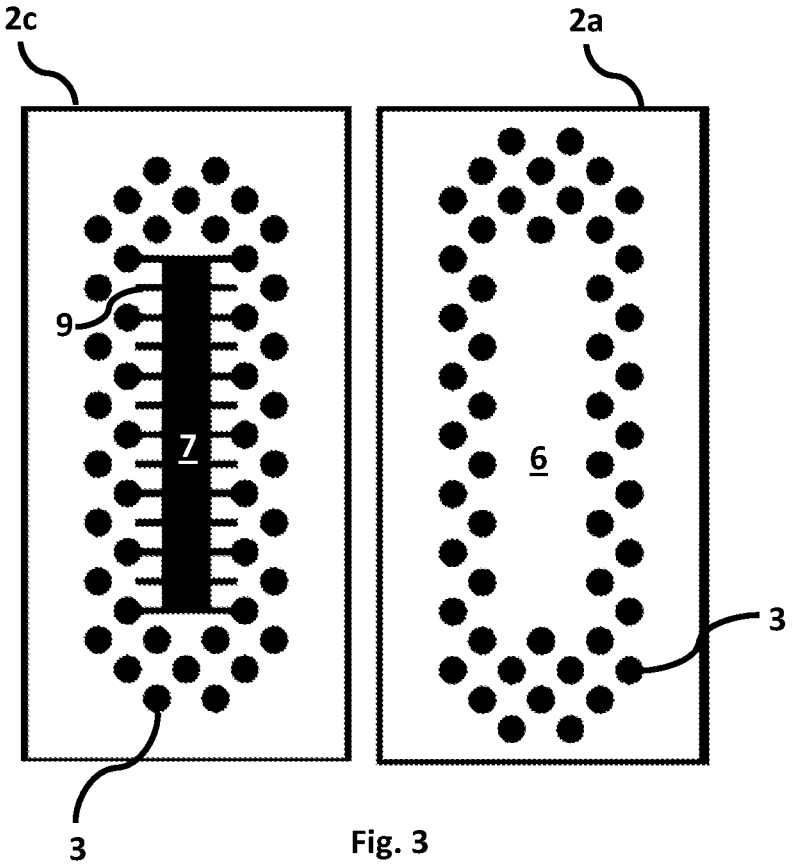
FIG. 3 illustrates two examples of layers for a multi-layer waveguide.

FIG. 3 illustrates embodiments of a top layer 2*a* and an intermediate layer 2*c*, being examples of how a pattern of holes, inlet, outlet, and apertures for different layers might look. FIG. 3 further illustrates an elongated aperture 7 that in an assembled multi-layer waveguide 1, either on its own or together with elongated apertures 7 of adjoining layers. forms the waveguide channel 77, see for example FIG. 5. The elongated aperture is here also shown with flanges 9, further discussed below.

In FIG. 3, an elongated area 6 in this embodiment, the top layer 2*a* is shown. The elongated area 6 is a solid part of the layer. The holes 3, elongated apertures 7, and/or inlets etc. are formed by removing material to create through going openings in the layer.

Figure 4:
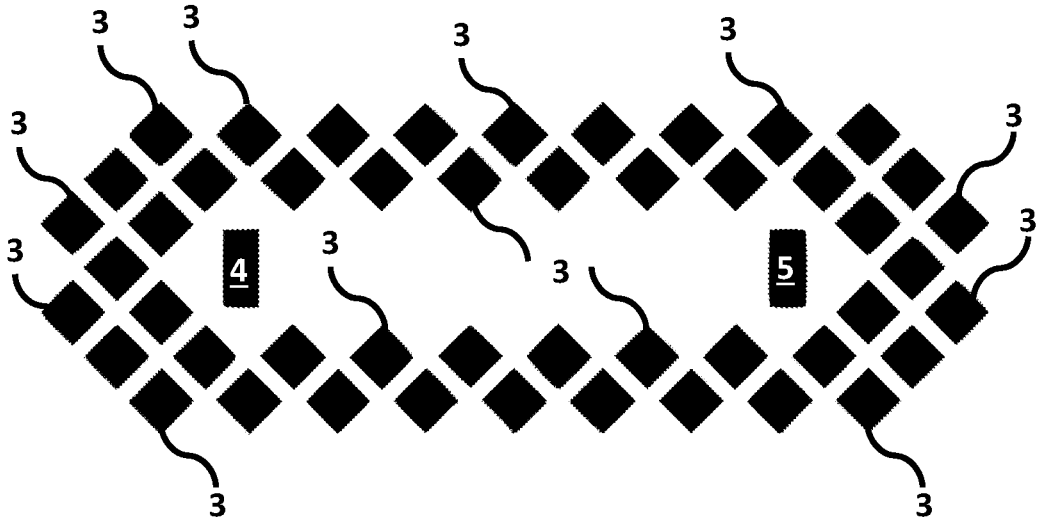
FIG. 4 illustrates one embodiment of a hole pattern for a top layer of a multi-layer waveguide.

FIG. 4 illustrates one embodiment of a pattern of openings in a layer. This layer may be either a top layer 2*a*, a bottom layer 2*e*, or an intermediate layer, e.g. corresponding to any one of the intermediate layers shown in FIG. 1. When the shown embodiment corresponds to an intermediate layer, a multi-layer waveguide comprising such a layer would also comprise a top layer or bottom layer having a waveguide inlet and a waveguide inlet arranged at the same place as the shown waveguide inlet 4 and the waveguide outlet 5, but with holes arranged with an offset to the holes 3 shown in FIG. 4.

Figure 5:
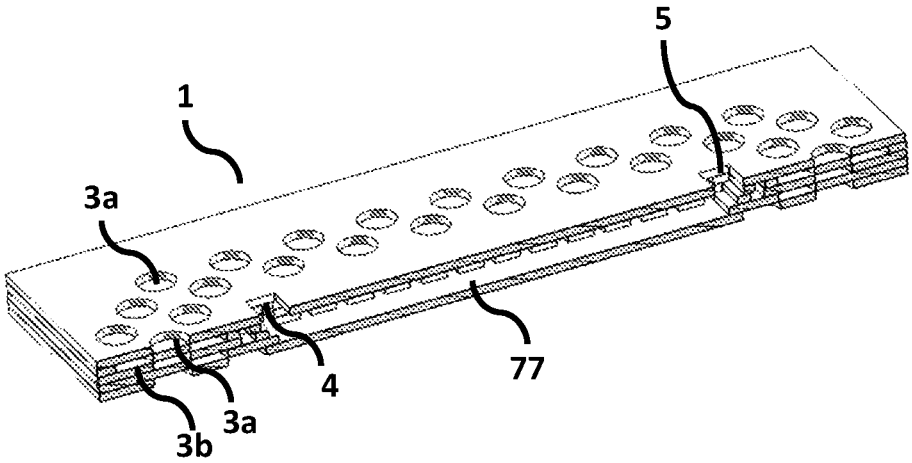
FIG. 5 illustrates a vertical cross-section of one embodiment of a multi-layer waveguide.

FIG. 5 illustrates a cross section of one embodiment of a multi-layer waveguide 1, where the holes are illustrated as holes 3*a*-3*b* in different layers. The holes 3*a* in the top layer 2*a* are arranged with an offset to the holes 3*b* in one of the three intermediate layers shown in FIG. 5. The cross section is here within the waveguide channel 77 which is clearly visible in FIG. 5. FIG. 5 further illustrates an embodiment of the multi-layer waveguide 1 where the waveguide channel 77 comprises a step structure formed in the intermediate layers and arranged at each end of the waveguide channel 77 to better direct an electromagnetic wave from the waveguide channel inlet 4, into the waveguide channel 77, and towards the waveguide channel outlet 5.

The step structure can be seen at both the channel inlet 4 and the channel outlet 5. The shown step structure also results in an example of elongated apertures of adjoining layers, here the intermediate layers, that form the waveguide channel 77, as mentioned above. The shown example also illustrates where the elongated aperture in a first intermediate layer is longer than the elongated aperture in a second intermediate layer and the elongated aperture in the second intermediate layer is longer than the elongated aperture in a third intermediate layer, as realized from studying the figure.

Figure 6:
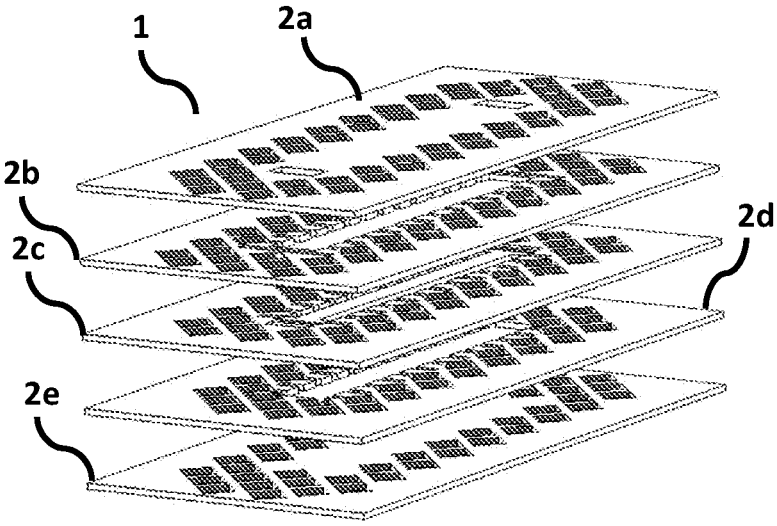
FIG. 6 illustrates one embodiment of multiple layers for a multi-layer waveguide.

FIG. 6 illustrates embodiments of layers 2*a*, 2*b*, 2*c*, 2*d*, 2*e* for a multi-layer waveguide 1. The layers as illustrated in FIG. 6 each comprises holes 3 that are arranged with an offset between the different layers, or at least between adjoining layers. FIG. 6 further illustrates orientation, or order, of the layers, where the top layer 2*a* is above the intermediate layers 2*b*, 2*c*, 2*d* and the intermediate layers 2*b*, 2*c*, 2*d* are above the bottom layer 2*e*. However, it should be noted that any number of layers can be used for the multi-layer waveguide and the multi-layer waveguide can be arranged, or oriented, in any direction during use. The orientation in examples herein and how it relates to the named order of the layers, is merely for explanatory reasons. However, in some embodiments, the multi-layer waveguide may be arranged just as illustrated and described herein.

Figure 7:
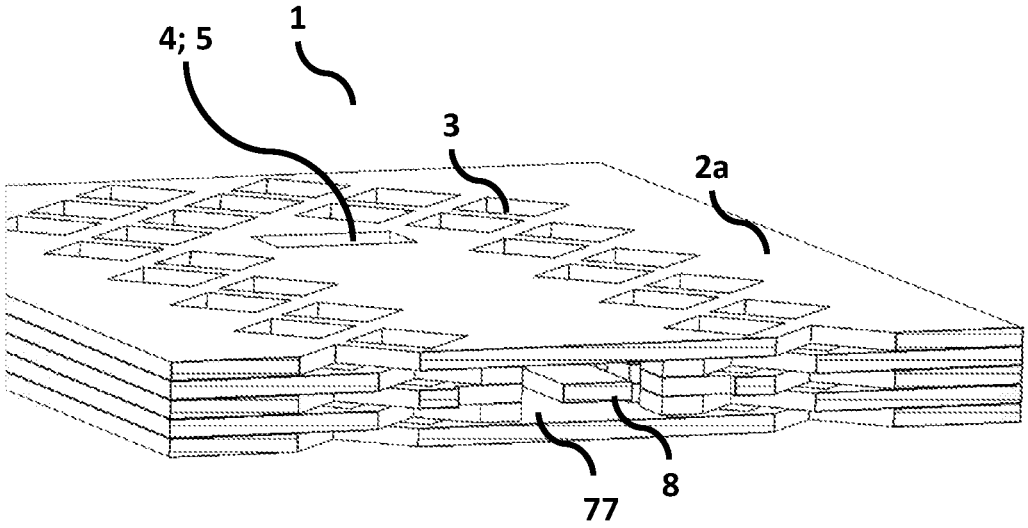
FIG. 7 illustrates a vertical cross-section of one embodiment of a coaxial multi-layer waveguide.

FIG. 7 illustrates a cross section of one embodiment of the multi-layer waveguide 1, with holes 3 indicated in a top layer 2*a* and where a central member 8 is arranged within the waveguide channel 77, creating a coaxial waveguide. It is understood that the central member 8 may have any form or shape. The central member 8 may be arranged in multiple layers if other structures of the coaxial waveguide than the structure shown in FIG. 7 are desirable to accomplish-. A waveguide channel inlet 4 and a waveguide channel outlet 5 are shown in the top layer 2*a*.

Figure 8:
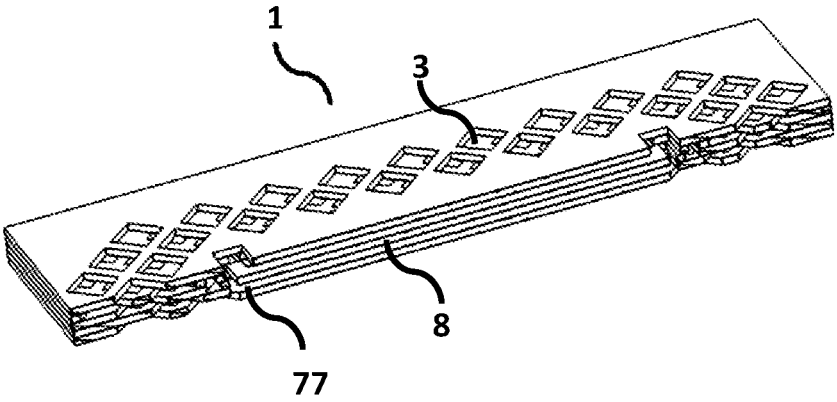
FIG. 8 illustrates a vertical cross-section of one embodiment of a coaxial multi-layer waveguide.

FIG. 8 illustrates another cross section of one embodiment of a multi-layer waveguide 1 being a coaxial waveguide, wherein a central member 8 is arranged in the center part of a waveguide channel 77. Holes 3 are indicated in the figure.

Figure 9A:
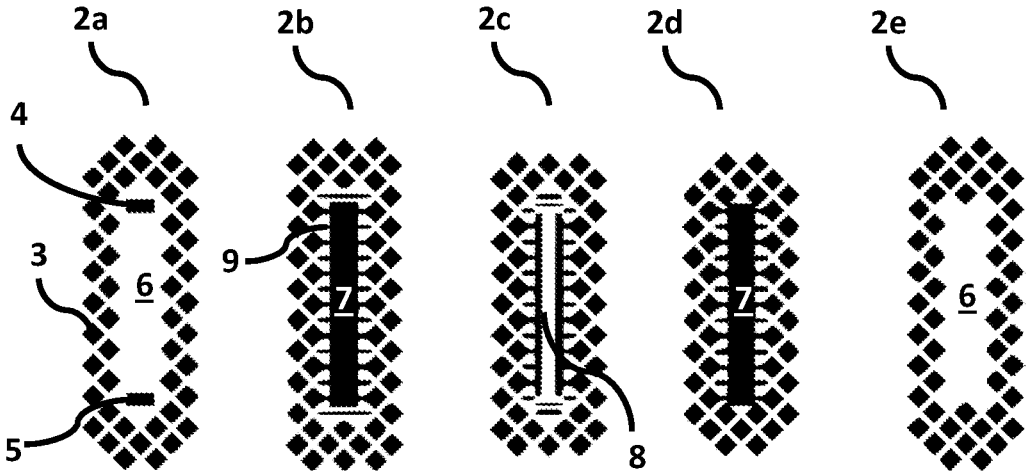
FIG. 9*a*-9*c* illustrates different embodiments of hole patterns of layers in a multi-layer waveguide.
Figure 9B:
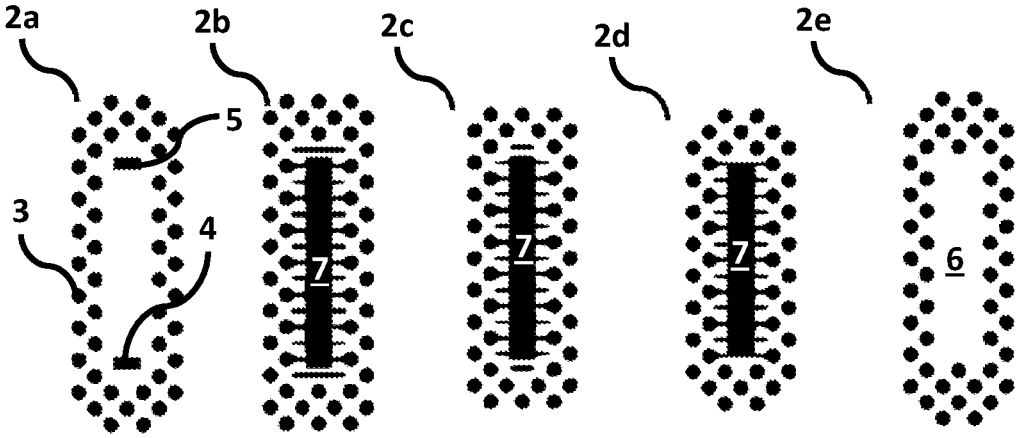
Figure 9C:
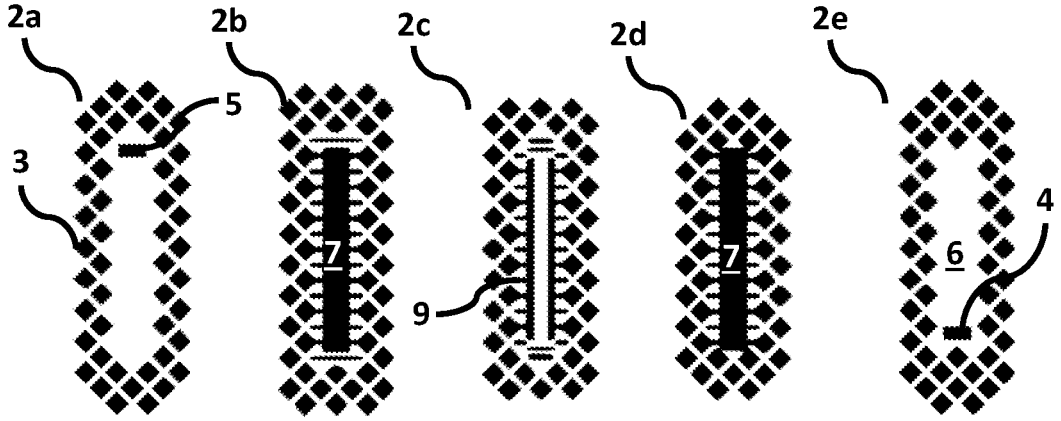

FIGS. 9*a*-9*c* illustrate different embodiments of patterns for layers in a multi-layer waveguide 1. Openings, that is, holes 3, a waveguide channel inlet 4, a waveguide channel outlet 5, and elongated apertures 7 are illustrated in FIGS. 9*a*-9*c*. It is understood that the inlet 4 and outlet 5 may switch place without affecting the overall function of the waveguide, i.e., that the direction for guiding waves in the waveguide can be switched.

FIG. 9*a* illustrates a multi-layer coaxial waveguide with a rectangular cross section. A top layer 2*a* here comprises multiple holes 3 arranged in two rows surrounding an elongated area 6. In the elongated area 6 is a waveguide channel inlet 4 and a waveguide channel outlet 5 arranged, both being through going apertures extending through the top layer 2*a*.

The first intermediate layer 2*b* shows a number of flanges 9 arranged around an elongated aperture 7 that is part of a waveguide channel as previously disclosed. The elongated aperture 7 extends between and connects to the inlet 4 and outlet 5 as illustrated. The second intermediate layer 2*c* comprises a central member 8 that is a solid member that when the waveguide is assembled will create the part making the waveguide channel coaxial. The third intermediate layer 2*d* illustrates an elongated aperture 7 with flanges.

Further relating to the flanges 9, in one embodiment the flanges are reversed, i.e. extending into the waveguide channel.

One advantage with the side flanges is that the side flanges reduce leakage through minimizing the waves' ability to couple with the edge and forcing the wave to propagate in a specific direction. Losses are thereby reduced. This is due to the discontinuity in the edge. Waves coupling to the edge of a waveguide loses energy which is at least in part prevented with the flanges as described herein.

According to one embodiment the flanges are reversed, i.e. extending into the waveguide channel, such as the waveguide channel 77.

FIG. 9*a* further illustrates a bottom layer 2*e* with two rows of holes 3 and an elongated area 6.

FIG. 9*b* illustrates another embodiment of layers in a multi-layer waveguide where the holes 3 are round instead of square as in FIG. 9*a*. Further FIG. 9*b* illustrates layers for a multi-layer waveguide that are not coaxial and there is thus no central member as in FIG. 9*a*. The layers in FIG. 9*b* correspond to layers as in FIG. 9*a*, that is, there is a top layer 2*a*, a first intermediate layer 2*b*, a second intermediate layer 2*c*, a third intermediate layer 2*d*, and a bottom layer 2*e*. Except from said differences the multilayer waveguides of FIGS. 9*a* and 9*b* may be similar, for example with an inlet 4 and outlet 5 in the top layer 2*a*, elongated areas 6 and elongated apertures 7, as shown in the figure.

FIG. 9*c* illustrates another embodiment of a coaxial multi-layer waveguide wherein a waveguide channel inlet 4 is arranged in the bottom layer 2*e* and a waveguide channel outlet 5 is arranged in a top layer 2*a*. The rest of the layers in FIG. 9*c* correspond to layers as in FIGS. 9*a* and 9*b*, that is, there is a first intermediate layer 2*b*, a second intermediate layer 2*c* with flange 9, a third intermediate layer 2*d*, and a bottom layer 2*e*. Moreover, there are elongated areas 6 and elongated apertures 7, as shown in the figure.

Figure 10A:
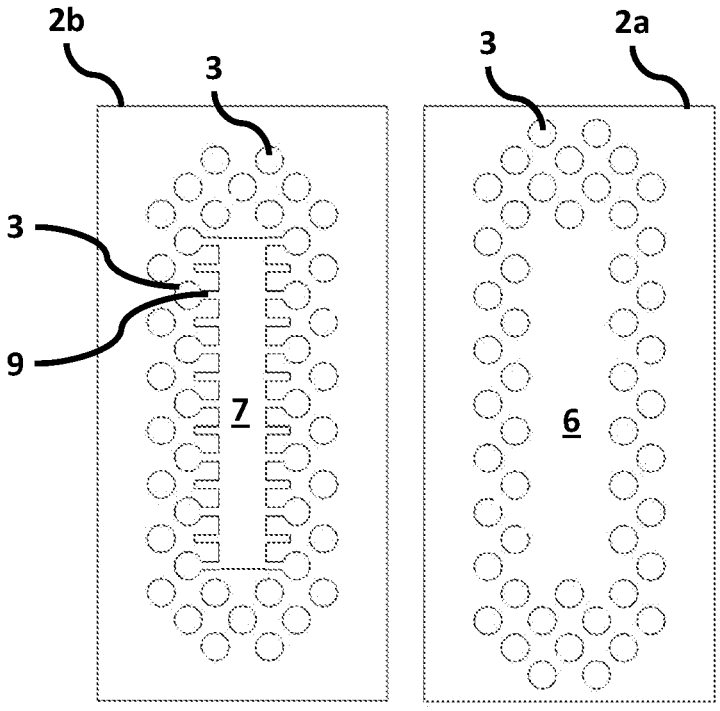
FIG. 10*a* illustrates one embodiment with two layers, shown side-by-side, for a multi-layer waveguide.

FIG. 10*a* illustrates a top layer 2*a* and an intermediate layer 2*b* side by side showing the holes 3. Moreover, an elongated area 6 and an elongated aperture 7 is shown in the figure.

Figure 10B:
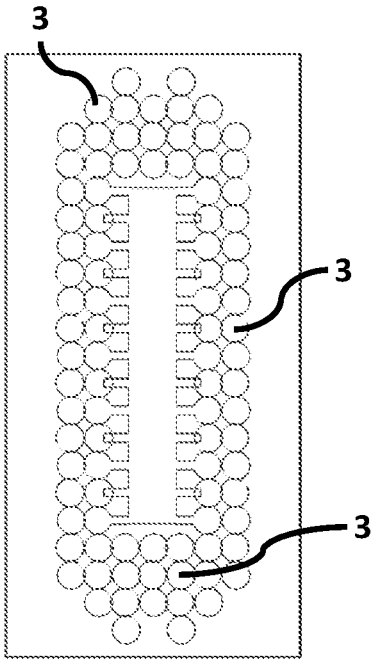
FIG. 10*b* illustrates the two layers as shown in FIG. 10*a* but here instead stacked for showing one embodiment with offset between holes in adjacent layers of the multi-layer waveguide.

FIG. 10*b* illustrates the top layer 2*a* and the intermediate layer 2*b* that are illustrated in FIG. 10*a* but with the layers stacked on top of each other. From this view, it is clear how the offset of the holes 3 in one embodiment could look like. However, it should be noted that the solution is not limited to any specific design and any pattern of holes 3 that creates an EBG structure is within the scope of the solution. Flanges 9, as mentioned above, are shown in both FIGS. 10*a* and 10*b*.

Figure 11:
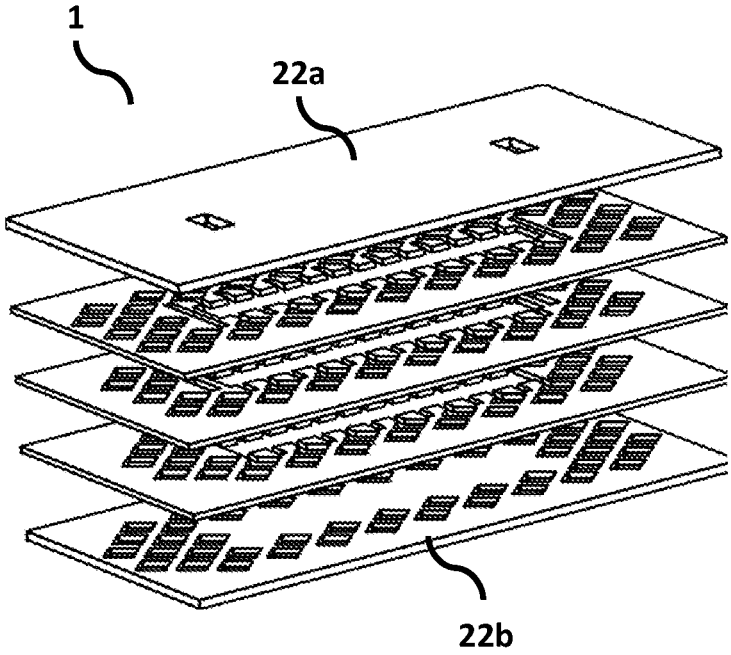
FIG. 11 illustrates one embodiment of multiple layers for a multi-layer waveguide with additional, or second, top and bottom layers.

FIG. 11 illustrates another embodiment of a multi-layer waveguide 1. In the embodiment illustrated in FIG. 11, the waveguide comprises one additional top layer 22*a* and one additional bottom 22*b* layer. The additional layers have holes 33 that don't extend the entire length through the layer.

Figure 12:
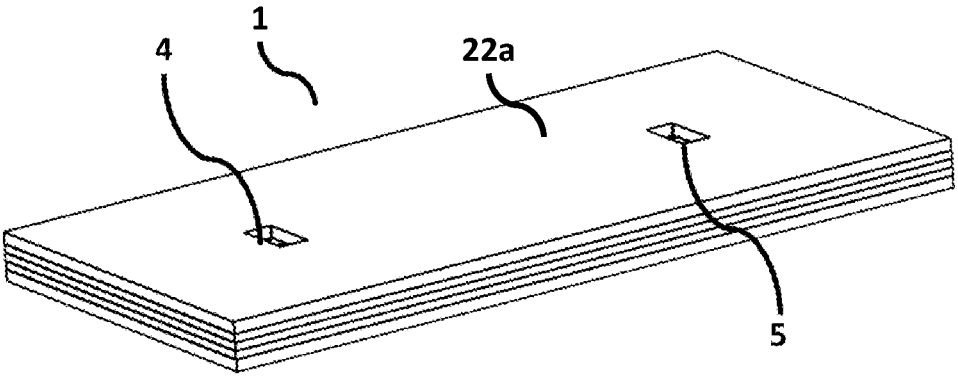
FIG. 12 illustrates one embodiment of an assembled multi-layer waveguide comprising the layers as illustrated in FIG. 11.

FIG. 12 illustrates a multi-layer waveguide 1 comprising the layers of FIG. 11. FIG. 12 illustrates how the waveguide 1 comprises a waveguide channel inlet 4 and a waveguide channel inlet 5 being apertures, holes, or openings, that in the shown embodiment are located in the additional top layer 22*a* of the multi-layer waveguide 1.

Figure 13:
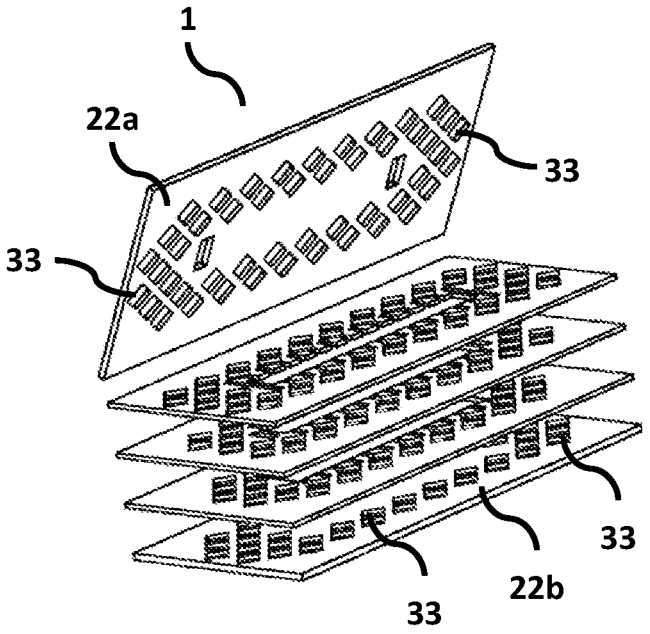
FIG. 13 illustrates another view of the embodiment as illustrated in FIGS. 11 and 12.

FIG. 13 also illustrates the layers of the embodiment of the multi-layer waveguide 1 as illustrated in FIGS. 11 and 12. The figure indicates the additional top layer 22*a* and the additional bottom layer 22*b* with said holes 33 that don't extend entirely through the layer.

Figure 14:
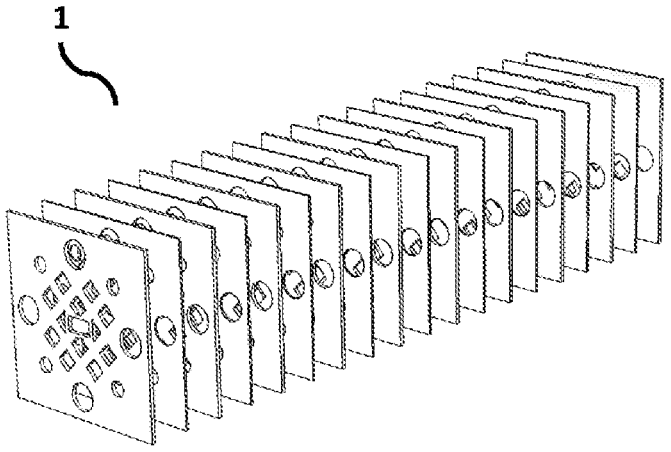
FIG. 14 illustrates one example of a waveguide device where the waveguide channel is arranged to be used as a filter.

FIG. 14 illustrates another embodiment of a multi-layer waveguide 1 according to some embodiments. The multi-layer waveguide 1 here has another form of waveguide channel than some of the other embodiments herein. In the embodiment illustrated in FIG. 14, the waveguide channel extends perpendicularly through the extension direction of the layers.

The invention claimed is:

1. A multi-layer waveguide device comprising:

at least three horizontally divided layers assembled into a multi-layer waveguide, wherein the at least three horizontally divided layers are at least a top layer, an intermediate layer, and a bottom layer, each of the at least three horizontally divided layers has respective through going empty holes extending through an entirety of the respective layer, and the respective through going empty holes are arranged with an offset with respect to adjacent through going empty holes of adjoining layers thereby creating a leak suppressing structure.

2. The multi-layer waveguide device according to claim 1, wherein the multi-layer waveguide further comprises a waveguide channel, said waveguide channel is an elongated aperture in at least one intermediate layer of the at least three horizontally divided layers.

3. The multi-layer waveguide device according to claim 2, wherein the multi-layer waveguide further comprises a waveguide channel inlet aligning with a start of the waveguide channel and a waveguide channel outlet aligning with an end of the waveguide channel, wherein the waveguide channel inlet is arranged according to any one of:

in the top layer, and in the bottom layer, and the waveguide channel outlet is arranged according to any one of:

in the top layer, and in the bottom layer.

4. A method for producing a multi-layer waveguide device according to claim 1, the method comprising etching or laser cutting the respective through going empty holes in each of the at least three horizontally divided layers.

5. The multi-layer waveguide device according to claim 1, wherein the intermediate layer in the multi-layer waveguide has at least a first, a second, and a third intermediate layer, and wherein each of the first, second and third intermediate layers comprises an elongated aperture arranged concentric for each of the first, second and third intermediate layers.

6. The multi-layer waveguide device according to claim 5, wherein the elongated aperture in the first intermediate layer is longer than the elongated aperture in the second intermediate layer and the elongated aperture in the second intermediate layers is longer than the elongated aperture in the third intermediate layer such that a stepped structure is defined at each end of the elongated aperture.

7. The multi-layer waveguide device according to claim 5, wherein the second intermediate layer further comprises a central member arranged within the elongated aperture.

8. The multi-layer waveguide device according to claim 1, wherein the multi-layer waveguide is arranged as any one of a slotted array antenna, a filter, a rectangular waveguide, and a coaxial waveguide.

9. The multi-layer waveguide device according to claim 1, wherein the multi-layer waveguide further comprise at least one of a second top layer arranged on top of the top layer and a second bottom layer arranged underneath the bottom layer, wherein said at least one of the second top layer and the second bottom layer comprises holes that extend only partly through the at least one of the second top layer and the second bottom layer.

10. The multi-layer waveguide device according to claim 1, wherein each of the through going empty holes has any one of a circular, triangular, square, pentagonal, hexagonal, and rectangular shape.

11. The multi-layer waveguide device according to claim 1, wherein the multi-layer waveguide further comprises a waveguide channel, said waveguide channel being an aperture extending through all of the at least three horizontally divided layers.

12. The multi-layer waveguide device according to claim 11, wherein at least one row of the through going empty holes is arranged around the waveguide channel.

13. The multi-layer waveguide device according to claim 11, wherein the waveguide channel comprises multiple side flanges extending in a direction perpendicular to an extension direction of said waveguide channel.

14. A method for producing a multi-layer waveguide device, the method comprising:

etching or laser cutting through going holes of a top layer of the multi-layer waveguide device, the through going holes surrounding an elongated area in a center area of the top layer, etching or laser cutting through going holes of at least one intermediate layer of the multi-layer waveguide device, the through going holes surrounding an elongated area in a center area of the at least one intermediate layer, etching or laser cutting an elongated aperture into the elongated area of the at least one intermediate layer, and etching or laser cutting through going holes of a bottom layer of the multi-layer waveguide device, the through going holes surrounding an elongated area in a center area of the bottom layer.

15. The method according to claim 14, wherein the top layer, the at least one intermediate layer, and the bottom layer are held together with any one of a conductive glue, an isolating glue, and screws.

16. The method according to claim 14, further comprising:

etching or laser cutting a waveguide channel inlet into any one of the top layer and the bottom layer, and etching or laser cutting a waveguide channel outlet into any one of the top layer and the bottom layer.

* * * * *